United States Patent [19]

Plonski

[11] 4,312,390

[45] Jan. 26, 1982

[54] DISPENSING DEVICE FOR COFFEE AND THE LIKE

[76] Inventor: Edward Plonski, 291 W. Washington St., Bristol, Conn. 06010

[21] Appl. No.: 140,219

[22] Filed: Apr. 14, 1980

[51] Int. Cl.[3] ..... B65B 3/04

[52] U.S. Cl. ..... 141/380; 141/360

[58] Field of Search ..... 141/346, 347, 348, 349, 141/350, 351, 352, 353, 354, 355, 356, 357, 359, 360, 361, 362, 380, 381, 250–284

[56] References Cited

U.S. PATENT DOCUMENTS

| | | | |
|---|---|---|---|
| 1,282,810 | 10/1918 | Godfrey et al. | 141/362 |
| 1,412,329 | 4/1922 | Altenberg | 141/360 |
| 3,351,239 | 11/1967 | Flock | 141/361 |
| 3,543,814 | 12/1970 | Awotto | 141/360 |

*Primary Examiner*—Houston S. Bell, Jr.

*Attorney, Agent, or Firm*—McCormick, Paulding & Huber

[57] ABSTRACT

A coffee dispensing device comprising a bracket and spring retainer for securing the device adjacent the mouth of a container. Ears on the bracket secure a parti-spherical inner closure member. A dispensing cup has its mouth adjacent a central opening in the inner closure member and is moveable between loading and dispensing positions within the member. The cup is biased to the dispensing position and an outer closure member slides over and about the inner closure member in sealing engagement. A handle for the outer closure member serves as an acutator for the dispensing cup and has a push rod for moving the cup to its loading position and its dispensing position. In the loading position and with the container inverted, coffee falls beneath the cup within the inner closure member, and in the dispensing position the coffee falls from within the cup through the opening in the inner closure member and into the outer closure member.

10 Claims, 5 Drawing Figures

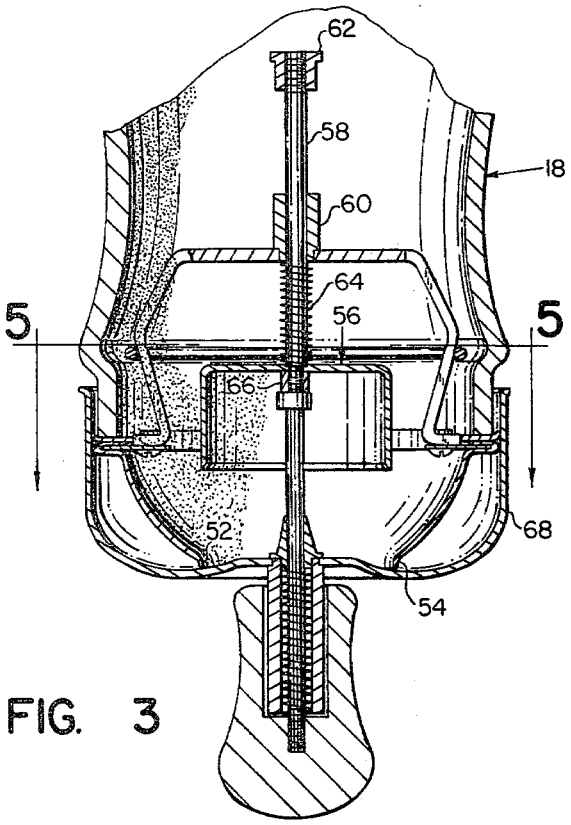
FIG. 3
FIG. 4
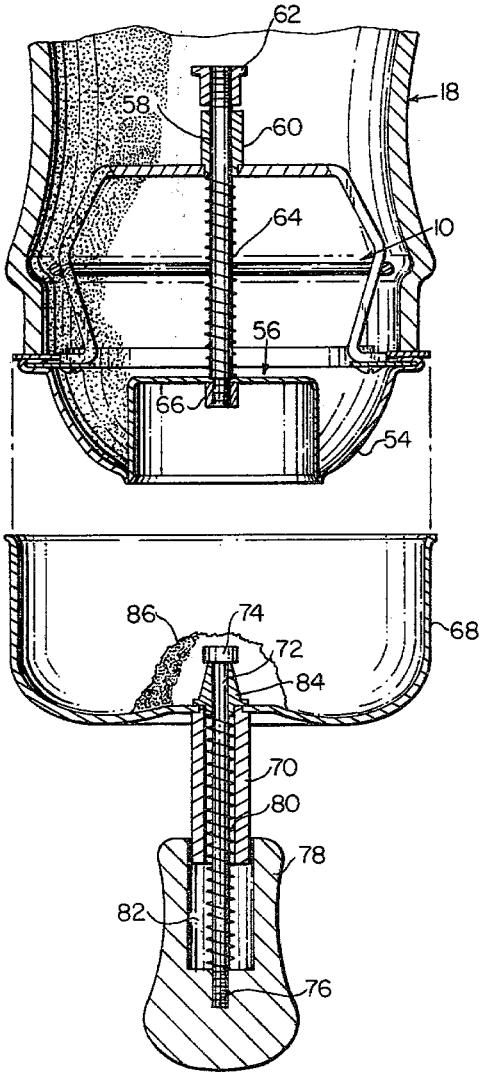
FIG. 5
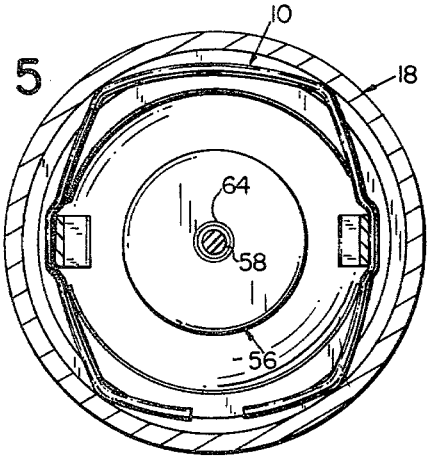

DISPENSING DEVICE FOR COFFEE AND THE LIKE

BACKGROUND OF THE INVENTION

Various measuring and dispensing devices for granular or powdered coffee and the like have heretofor been available. Such devices have not, however, been wholly satisfactory. Certain of the devices have been inaccurate or inefficient in measuring and dispensing operations, complex and uneconomical in construction and in many of the devices no provision is made for proper sealing of an associated container against the entrance of air, the resulting loss of flavor of the coffee or other material within the container causing a continuing problem for purchasers and users of the devices.

It is the general object of the present invention to provide an improved dispensing device for coffee and the like, the device being characterized by simplicity in construction and resulting manufacture at economic advantage, a high degree of ease and convenience in use, and an efficient sealing operation for the maintainance of flavor of coffee or other material within a container in which the device is used.

SUMMARY OF INVENTION

In fulfillment of the foregoing object, an improved dispensing device for coffee and the like is provided and comprises an attachment means for releasably securing the device to a container having a cylindrical opening. An inner closure means for the container opening is connected with and supported in position over the opening by the attachment means. The closure means has a through opening aligned with the container opening for the discharge of coffee therefrom with the container in an inverted position. A small coffee measuring and dispensing cup has its mouth arranged to face the opening in the inner closure means and to dispense coffee downwardly therethrough, the cup being disposed within and in an inverted position in the inner closure means with the container inverted. The dispensing cup is supported for movement between loading and dispensing positions within the inner closure means with the loading position of the cup having the mouth of the cup spaced from the closure means so that coffee may fall therebeneath within the closure means. In the dispensing position of the cup, the marginal portions thereof defining the mouth engage the closure means about the opening therein so as to prevent coffee from falling from the container outwardly through the opening. Thus, only coffee within the cup is discharged downwardly through the opening in the inner closure means. A biasing means urges the dispensing cup toward its dispensing position and the cup is urged to its loading position by an actuator means described hereinbelow.

The improved dispensing device also includes an outer closure means which is releasably engageable with and in sealing relationship with a marginal portion of the inner closure means. When the outer closure means is engaged with the inner closure means the container is sealed against the entry of air and the loss of flavor of coffee or other material therewithin is effectively prevented. When the outer closure means is removed from engagement with the inner closure means it may serve as a means for receiving coffee discharged from the dispensing cup through the opening in the inner closure means and for transporting the same to a further container such as a cup or the like.

The aforementioned actuator means for the dispensing cup is operatively associated with the outer closure means and is manually operable from a position externally of the outer closure means to move the dispensing cup between its said loading and dispensing positions. In preferred form, the actuator takes the form of a handle for the outer closure means which serves the dual function of actuating the dispensing cup and facilitating the manual manipulation of the outer closure means in engaging and disengaging the same with the inner closure means and transporting coffee or the like dispensed in measured quantity from the dispensing cup.

DESCRIPTION OF THE DRAWINGS

FIG. 3 is a vertical sectional view generally similar to FIG. 2 but illustrating the dispensing device in a condition wherein the dispensing cup is in a loading position prior to dispensing a measured quantity of coffee.

FIG. 4 is a vertical sectional view generally similar to FIG. 3 but illustrating the dispensing device in a coffee dispensing condition, the dispensing cup being shown in a dispensing position and the outer closure means being disengaged from the inner closure means and the container so as to receive the dispensed coffee or the like.

FIG. 5 is a horizontal sectional view taken generally as indicated in 5,5 in FIG. 3 and illustrating a part of an attachment for securing the improved dispensing device to a container.

DESCRIPTION OF PREFERRED EMBODIMENT

Figure 1:
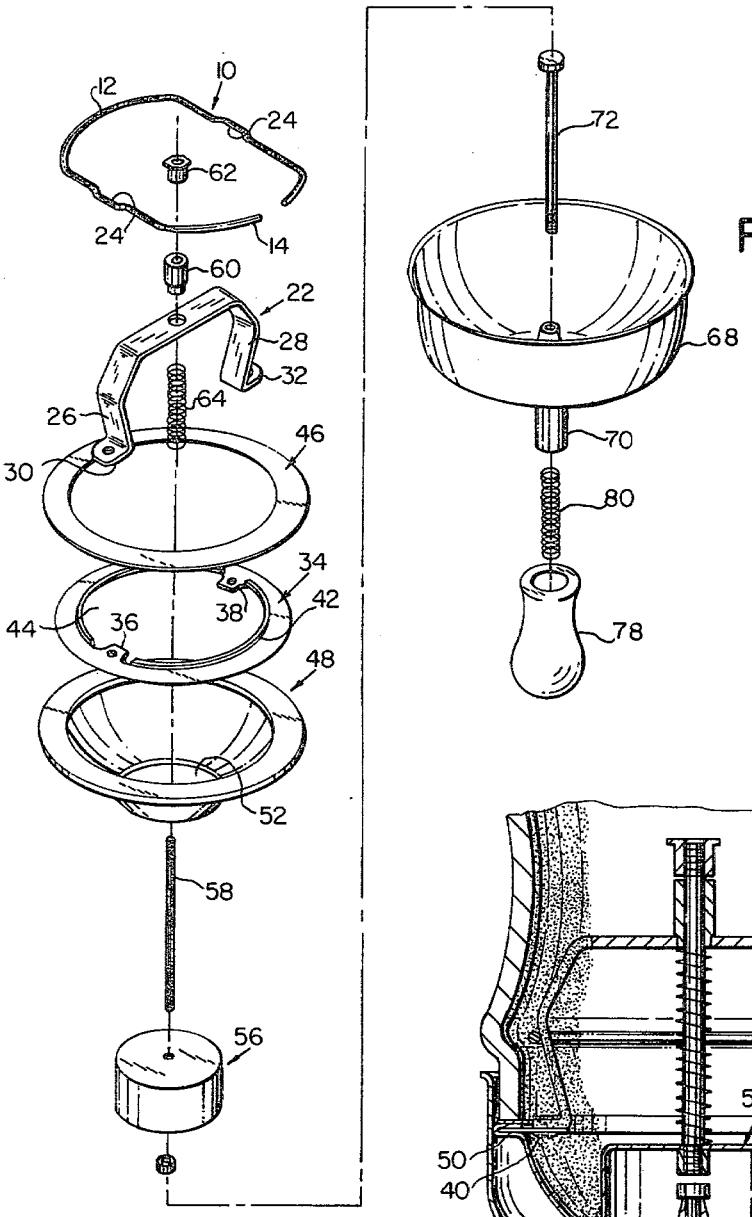
FIG. 1 of the drawings is an exploded view in perspective showing the various elements comprising the improved coffee dispensing device of the present invention.

Referring particularly to FIG. 1, it will be observed that a spring retainer 10 takes a generally rectangular configuration with slightly arcuate end portions 12,14 and with the end portion 14 open for spring action. The retainer 10 forms a part of an attachment means in the improved dispensing device of the invention and may be compressed manually so as to be entered through the mouth 16 of a container 18, FIG. 2 et sequa. A diametrically enlarged portion 20 of the container 18 receives the retainer 10 and when inward pressure is released on the retainer it will of course spring outwardly to the position shown for retention in the enlarged portion 20, FIG. 5. In containers not having a diametrically enlarged portion such as 20, or if desired for other reasons, other attachment means may of course be provided for external and/or internal attachment to a container.

The retainer 10 has an operatively associated generally U-shaped bracket 22, also forming a part of the attachment means of the dispensing device. The generally U-shaped member 22 is received in a pair of recesses 24,24 along straight side portions of the retainer 10 for securing the member 22 in a container. That is, legs 26,28 of the U-shaped member are slightly bowed along their length so as to snap into position with an enlarged portion thereof disposed inwardly of the retainer 10 and thus to hold the U-shaped member in the position shown in FIG. 2 et sequa.

The U-shaped member 22 also has apertured ears 30,32 at the ends of its legs for the attachment of an inner closure means thereto. Ring 34, forming a part of the inner closure means has inwardly projecting ears 36,38 which are also apertured and arranged to engage the ears 30,32 with the apertures of the corresponding ears in alignment for receipt of small screws 40,40, FIG. 2 et sequa. With the ring 34 thus secured to the U-shaped member 22 a narrow flange 42 adjacent its central opening 44 enters the mouth 16 of container 18 and engages the mouth defining edge portion of the container for proper location of the ring and remaining parts of the dispensing device relative to the container.

Figure 2:
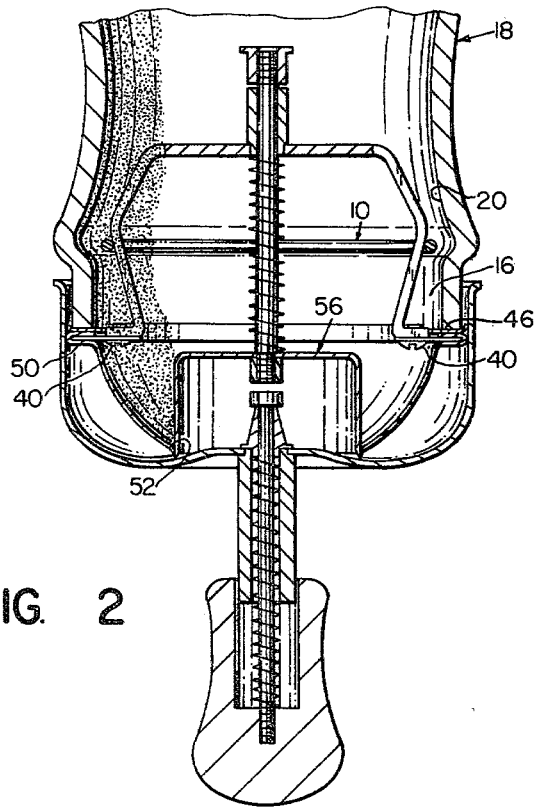
FIG. 2 is a vertical sectional view through a container with the improved dispensing means of the present invention mounted thereon and illustrated in a condition of readiness for dispensing coffee to an outer closure means.

Ring seal or sealing element 46 is slightly larger than the ring 34 in diameter and is disposed adjacent the mouth of the container 16 and in engagement with the edge portion of the container as illustrated in FIG. 2 et sequa.

The inner closure means of the dispensing device also comprises a parti-spherical member 48 which has a free edge portion 50, FIG. 2 et sequa, rolled about the outer edge portion of ring 34 so as to be secured thereto and, in turn, secured to the U-shaped member 22. The inner or rear portion of the rolled over portion of the parti-spherical member engages and clamps the ring seal 46 in position.

At its outer portion, the parti-spherical member 48 has a through opening 52 which is in communication with and in alignment with the opening or mouth of the container 18 so as to dispense coffee or other granular or powdered material from the interior of the container 18 when the latter is in the inverted attitude of FIG. 2 et sequa. The opening 52 is generally circular in the preferred form illustrated and a small peripheral flange is preferably provided adjacent the opening as best illustrated at 54 in FIG. 3. The flange 54 projects outwardly to provide a sealing function as described hereinbelow.

A small measuring and dispensing cup 56 is disposed within the interior of the parti-spherical inner closure member 48 as best illustrated in FIG. 2 et sequa. The cup 56 is arranged to face the interior of the member 48 and has edge portions thereof adapted to engage the marginal edge portions of the member 48 adjacent its opening 52 as best illustrated in FIG. 2 with the cup in a dispensing position. In this position, the cup 56 prevents the inadvertent or accidental outflow of coffee of other material from the interior of the container 18 through the opening 52 and only coffee within the cup 56 is allowed to discharge through the opening as will be explained more fully hereinbelow.

The cup 56 also has an upwardly spaced or loading position as illustrated in FIG. 3, and in such position the cup 56 is in communication with the interior of the inner closure member 48 and the interior of the container 18 with the container inverted as illustrated.

In order to provide for movement of the cup 56 between its loading and dispensing positions, the cup is mounted on a slide rod 58 journaled at 60 in the U-shaped bracket 22 having a stop member 62 at an inner end portion. A biasing spring 64 resides between the U-shaped bracket 22 and the bottom of the dispensing cup 56 to urge the cup toward its dispensing postion of FIG. 2. A small collar 66 threadably receives an end portion of the slide rod 58 to secure the cup thereto.

An outer closure means of the dispensing device of the present invention preferably takes the form of a generally parti-spherical member 68 somewhat larger than the member 48 and adapted to be releasably engageable with a marginal portion of the inner closure means, more specifically with the ring seal 46. As shown, an open end portion of the member 68 is adapted to be slideably entered over and about the ring seal 46 in sealing engagement therewith and with the remaining portion of the member 68 disposed about and in covering relationship with the inner closure member 48. The aforementioned annular flange 54 about the opening 52 in the inner closure member 48 engages the interior surface of the parti-spherical member 68 as best illustrated in FIG. 3 when the member 68 is entered on and about the inner closure member and urged toward the container to seat the flange. Thus, coffee or other material within the container 18 and within the inner closure member 48 is not permitted to discharge through the opening 52 when the member 68 is engaged in a closed position as illustrated in FIG. 3. When the member 68 is disengaged or withdrawn from the inner closure means as illustrated in FIG. 4, coffee is permitted to flow freely through the opening 52 in the inner closure member 48 but as illustrated, the dispensing cup 56 is at this time in its dispensing position and only the measured quantity of coffee within the dispensing cup is allowed to discharge to the member 68. As mentioned above, the marginal portion of the cup 56 adjacent its mouth resides in sealing engagement with the interior marginal portion of the closure member 48 to prevent coffee disposed about the cup from flowing through the opening 52.

The outer closure member 68 also has an operatively associated actuator for moving the dispensing cup 56 between its loading and dispensing positions. A hollow stem or sleeve 70 mounted on the parti-spherical member 68 receives a push rod 72 which has an enlarged inner end portion 74 and which extends outwardly beyond the stem or sleeve 70 to an opposite end portion 76 threadably engaged with the handle 78. A biasing spring 80 is disposed within the sleeve 70 and partially within an opening 82 in the handle 78 and urges the handle 78 and the push rod 72 outwardly or to the position shown in FIG. 4. A sealing element 84 seats one end of the spring 80 and is tightly engaged with an opening in the sleeve 70 and with the enlarged end portion 74 of the push rod 72 when the rod is positioned as shown. Thus, the element 84 serves to restrict the flow of air inwardly to the interior of the member 68 and to the interior of the container 18 when the member 68 is in its closed and sealing position as illustrated in FIG. 3.

As will be apparent, the handle 78 may be manipulated manually to urge the same inwardly or upwardly in FIG. 3 thereby causing the push rod 72 and its enlarged end portion 74 to engage the cup 56 and to in turn urge the cup 56 to its loading position of FIG. 3. On release of the handle 78, the biasing spring 64 will urge the cup 56 downwardly to its dispensing position as illustrated in FIG. 4 and the biasing spring 80 will urge the handle 78 and the push rod 72 to the position of FIG. 4.

From the foregoing it will be apparent that the container 18 may be stored in an upright position with the improved dispensing device of the present invention mounted thereon. Whenever there is a desire to dispense coffee of other granular or powdered material from the container, the container is inverted and the material therewithin falls downwardly to the position shown in FIG. 2, the dispensing cup 56 at this point in time being devoid of coffee but the coffee being disposed thereabout within the inner closure member 48. On actuation of the handle 78, or movement thereof upwardly, the push rod 72 urges the cup 56 upwardly to the loading position of FIG. 3. In this position of the cup 56 the coffee or other material will fill the inner closure member 48 and rise within the cup 56. On release of the handle 78 and resumption of the position shown in FIG. 4, the cup 56 will move downwardly to its dispensing position as illustrated in FIG. 4. In this position, the cup 56 seals the area within the inner closure member 48 so as to prevent the inadvertent discharge of coffee through the opening 52, but it is to be observed that coffee within and beneath cup 56 is captured therewithin. Thus, a measured quantity of coffee resides in the cup 56 and is retained therewithin by the interior surface of the member 68 in sealing engagement with the flange 54. When the member 68 is subsequently withdrawn from engagement with the inner closure means to the position shown in FIG. 4, coffee within the cup 56 falls through the discharge opening 52 to the position shown at 86 within the member 68. The member 68 may thereupon be employed as a means of transporting the coffee to a cup or other container. On emptying the coffee from the member 68 the member may again be employed to dispense measured quantities of coffee from the container or, the member may thereafter be replaced in the closed position of FIG. 3 and the container returned to its upright storage position.

A wide variety of granular, powder and other materials may be used with the dispensing device of the present invention and the device is similarly adaptable to a wide variety of containers. The foregoing description has referred to the discharge of coffee from the container 68 to a cup and contemplates the use of the dispensing device for instant coffee but the invention is not so limited. When used with any material which may suffer adverse effects from the entry of air, the dispensing device serves efficiently to seal the container with the frictional sliding engagement between the member 68 and the seal ring 46, and with the sealing of the enlarged push rod head 74 against the sealing member 84. When, as in accordance with the presently preferred form of the invention, all elements of the device subject to contact with coffee or other material are constructed of corrosion resistant material, further prevention against contamination of taste or flavor is provided for. Still further, the measured quantity of coffee or other material dispensed by the device may be readily varied merely by changing the size of the cup 56.

I claim:

1. A dispensing device for coffee and the like, said device comprising an attachment means for releasably securing the device to a container having a cylindrical opening, an inner closure means for the container opening connected with and supported in position over the opening by the attachment means, said closure means having a through opening aligned with the container opening for the discharge of coffee therefrom, a small coffee measuring the dispensing cup with its mouth arranged to face the opening in the closure means and to dispense coffee therethrough, said dispensing cup being supported for movement between loading and dispensing positions within said closure means and having associated biasing means urging the same toward its dispensing position, said cup in its loading position having its mouth defining edge spaced from said closure means and in communication with said container opening for the loading of coffee therefrom with the container inverted, and said cup in its dispensing position having its mouth defining edge in engagement with said closure adjacent the closure opening whereby to discharge coffee therewithin through the closure opening while preventing the inadvertent discharge of coffee from the container opening through said closure opening, an outer closure means releasably engageable in sealing relationship with a marginal portion of said inner closure means, and a dispensing cup actuator operatively associated with said outer closure means and manually operable from the exterior of said outer closure means to move said dispensing cup between its said loading and dispensing positions.

2. A dispensing device for coffee and the like as set forth in claim 1 wherein said dispensing cup actuator is disposed at least partially externally of said outer closure means so as to serve both as manually operable actuator for the dispensing cup and a handle for the outer closure means.

3. A dispensing device for coffee and the like as set forth in claim 1 wherein said outer closure means has a generally parti-spherical configuration with an open end portion slidable over and about said inner closure means in sealing relationship therewith.

4. A dispensing device for coffee and the like as set forth in claim 3 wherein said inner closure means has a generally parti-spherical configuration somewhat smaller than said outer closure means and disposed within said outer closure means when the latter is slidably engaged therewith in sealing relationship, and wherein said inner closure means opening is generally circular with the dispensing cup engageable with marginal portions of the closure means defining the opening and on the interior surface thereof, the exterior surface of said marginal portion engaging the interior surface of said outer closure means to prevent inadvertent coffee leakage through the opening when the outer closure means is slidably engaged with the inner closure means in sealing relationship.

5. A dispensing device for coffee and the like as set forth in claim 4 wherein said inner closure means includes a sealing member having a generally circular circumferential sealing edge portion which projects radially beyond the open end portion of the parti-spherical portion of said closure means whereby to sealingly engage the interior surface of said outer closure means when the latter is slidably engaged therewith.

6. A dispensing device for coffee and the like as set forth in claim 5 wherein said attachment means is designed for a container having a diametrically enlarged portion adjacent the mouth of the container and has a spring like member adapted to enter said diametrically enlarged portion so as to be retained therein against dislodgement and movement through the mouth of the container, and wherein said inner closure means is connected with said attachment means generally within the mouth of the container and within the interior of said parti-spherical portion thereof.

7. A dispensing device for coffee and the like as set forth in claim 6 wherein a biasing means for said dispensing cup is provided in operative association with said attachment means and comprises a slide rod connected with the cup and journal means associated with the attachment means for movement of the slide rod and the cup between its loading and dispensing positions, said biasing means also including a spring seated on the attachment means and urging the dispensing cup to its dispensing position wherein its mouth defining edge resides in engagement with said inner closure means adjacent the opening in said inner closure means.

8. A dispensing device for coffee and the like as set forth in claim 7 wherein said actuator takes the form of a manually operable handle and a hollow stem slidably mounting the handle thereon and fixed to the outer closure means, said handle having an operatively associated push rod which extends through the opening in the hollow stem and engages the dispensing cup at its inner end, and said handle and actuator also including a biasing spring urging the handle to an outer or inoperative position, the handle and actuator when urged manually inwardly causing the push rod to engage the dispensing cup through the opening in the inner closure member and to urge the cup from its dispensing position inwardly toward the mouth of the container to its loading position

9. A dispensing device for coffee and the like as set forth in claim 8 wherein a sealing element is provided internally of said outer closure means, and wherein said push rod is provided with an enlarged head engageable with the dispensing cup and with said sealing element, the biasing spring associated with said actuator and handle urging the enlarged head into sealing engagement with the sealing element in the absence of manual pressure on said handle whereby the outer closure means is sealed against air entry in its engaged position on and about the inner closure means and its disengaged condition may be employed to receive coffee dispensed from the dispensing cup and to transport the coffee in dispensed and measured quantities to a second container.

10. A dispensing device for coffee and the like as set forth in claim 9 wherein all of the elements of said dispensing device susceptible to contact with coffee from the container are constructed of corrosion resistant material.

* * * * *